US010550539B1

(12) United States Patent
Madruga et al.

(10) Patent No.: US 10,550,539 B1
(45) Date of Patent: Feb. 4, 2020

(54) SAFETY RAILING FOR UTILITY HATCH

(71) Applicant: Madruga Iron Works, Inc., Tracy, CA (US)

(72) Inventors: Joseph R. Madruga, San Jose, CA (US); Chad W. Crocker, Valley Springs, CA (US); Brian T. McAnulty, San Jose, CA (US); Raymond M. Madruga, San Ramon, CA (US); Vincent L. Tortorelli, Modesto, CA (US)

(73) Assignee: MADRUGA IRON WORKS, INC., Tracy, CA (US)

( * ) Notice: Subject to any disclaimer, the term of this patent is extended or adjusted under 35 U.S.C. 154(b) by 0 days.

(21) Appl. No.: 16/038,608

(22) Filed: Jul. 18, 2018

(51) Int. Cl.
*E02D 29/12* (2006.01)
*E04F 11/18* (2006.01)

(52) U.S. Cl.
CPC ..... *E02D 29/122* (2013.01); *E04F 11/1865* (2013.01)

(58) Field of Classification Search
CPC ..... E02D 29/122; E02D 29/127; E02D 29/12; E02D 29/14; E02D 29/1463; E02D 2200/15; E04F 11/1865
See application file for complete search history.

(56) References Cited

U.S. PATENT DOCUMENTS 4,266,380 A * 5/1981 Samolis ..... E02D 29/127 404/25
5,941,024 A * 8/1999 Journault ..... E02D 29/12 182/112
6,050,032 A * 4/2000 Yamada ..... E04G 21/3223 49/118
6,640,495 B1 * 11/2003 McKernan ..... E02D 29/127 49/142
6,688,046 B2 * 2/2004 Perkins ..... E02D 29/127 256/65.01
6,830,127 B2 * 12/2004 Johnson ..... E02D 29/12 182/113
7,516,575 B2 * 4/2009 Cuccurullo ..... E04D 13/0335 182/113
8,250,811 B2 * 8/2012 Zijlstra ..... E05C 1/10 292/57

(Continued)

FOREIGN PATENT DOCUMENTS

FR 2996238 * 4/2014 ..... E04F 11/1865
GB 2353313 A * 2/2001 ..... E02D 29/127
JP 10220024 A * 8/1998 ..... E02D 29/127

OTHER PUBLICATIONS

EJ Access Hatch Catalog, 2017, pp. 1-40, Rev Nov. 2017—Y0015, 40 pages.

(Continued)

*Primary Examiner* — Beth A Stephan

(57) ABSTRACT

A safety railing system for an underground utility enclosure includes a utility hatch frame for the underground utility enclosure or a utility hatch cover for the utility hatch frame, and a folding safety railing. The folding safety railing includes a first panel pivotally connected to the utility hatch frame or the utility hatch cover, and a second panel pivotally connected to the first panel. The folding safety railing unfolds so the first and the second panels stand vertically along one or more edges of the utility hatch frame.

20 Claims, 15 Drawing Sheets

FIG. 2-1

(56) References Cited

U.S. PATENT DOCUMENTS

| | | | | |
|---|---|---|---|---|
| 8,517,144 | B2 * | 8/2013 | Cuccurullo | E04D 13/0335 182/45 |
| 8,522,487 | B2 * | 9/2013 | Whiting | E05B 47/02 52/19 |
| 8,726,577 | B2 * | 5/2014 | Whiting | E04D 13/0335 256/25 |
| 9,045,906 | B1 * | 6/2015 | Richey | E04D 13/0357 |
| 10,100,576 | B1 * | 10/2018 | Dimovski | E06C 1/34 |
| 2004/0154241 | A1 * | 8/2004 | Joyce | E04D 13/0315 52/200 |
| 2005/0115173 | A1 * | 6/2005 | Joyce | E04D 13/0315 52/200 |

OTHER PUBLICATIONS

Nystrom Safety Railings Manual, Models SRA, SRV, SRT, Rev May 2018, 6 pages.

* cited by examiner

SAFETY RAILING FOR UTILITY HATCH

BACKGROUND

An underground utility enclosure (vault) locates utility equipment underground to improve service reliability, provide greater public safety, and enhance aesthetics. The underground utility enclosure typically includes a concrete body with a top access opening, a utility hatch frame around the access opening, and one or more utility hatch covers received in the utility hatch frame to close the access opening. Utility workers swing open or remove the utility hatch covers to access the utility equipment.

BRIEF DESCRIPTION OF THE DRAWINGS

In the drawings:

FIGS. 2-1, 2-2, 2-3, 3, 4, 5, 6, 7, and 8 are perspective views illustrating the operation of a safety railing system for the underground enclosure of FIG. 1 in some examples of the present disclosure.

FIGS. 10-1, 10-2, 10-3, 11, 12, 13, 14, and 15 are perspective views illustrating the operation of a safety railing system for the underground enclosure of FIG. 9 in some examples of the present disclosure.

Use of the same reference numbers in different figures indicates similar or identical elements.

DETAILED DESCRIPTION

Utility workers swing open or remove utility hatch covers to access utility equipment in an underground utility enclosure. With the utility hatch covers swung open or removed, a passerby or a utility worker may accidentally fall into the underground utility enclosure. Thus, what are needed are device and method to prevent such accidents.

Figure 1:
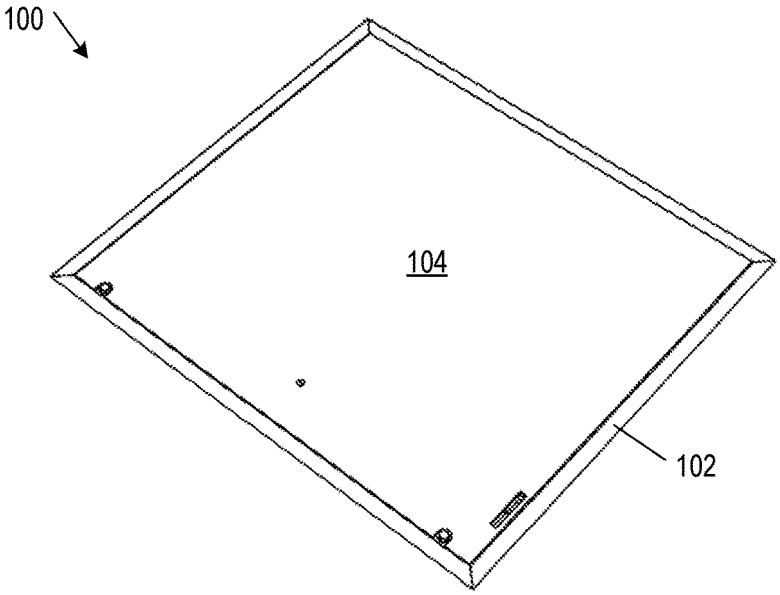
FIG. 1 is a perspective view of an underground enclosure having a hatch frame and a hatch cover in the hatch frame in some examples of the present disclosure.

FIG. 1 is a perspective view of an underground enclosure 100 having a hatch frame 102 and a hatch cover 104 for the hatch frame in some examples of the present disclosure. Underground enclosure 100 may be an underground utility enclosure, such as an underground utility vault, for locating utility equipment below ground.

FIGS. 2 to 8 are perspective views illustrating the operation of a safety railing system for underground enclosure 100 in some examples of the present disclosure.

Figures 1, 2:
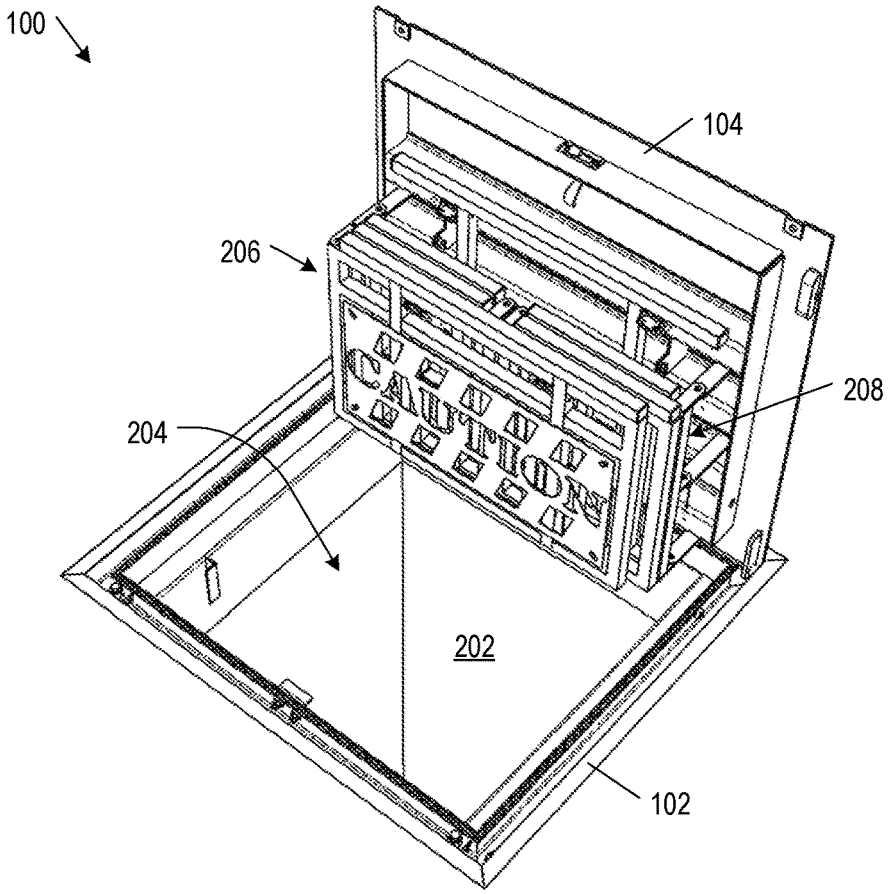
Figure 2:
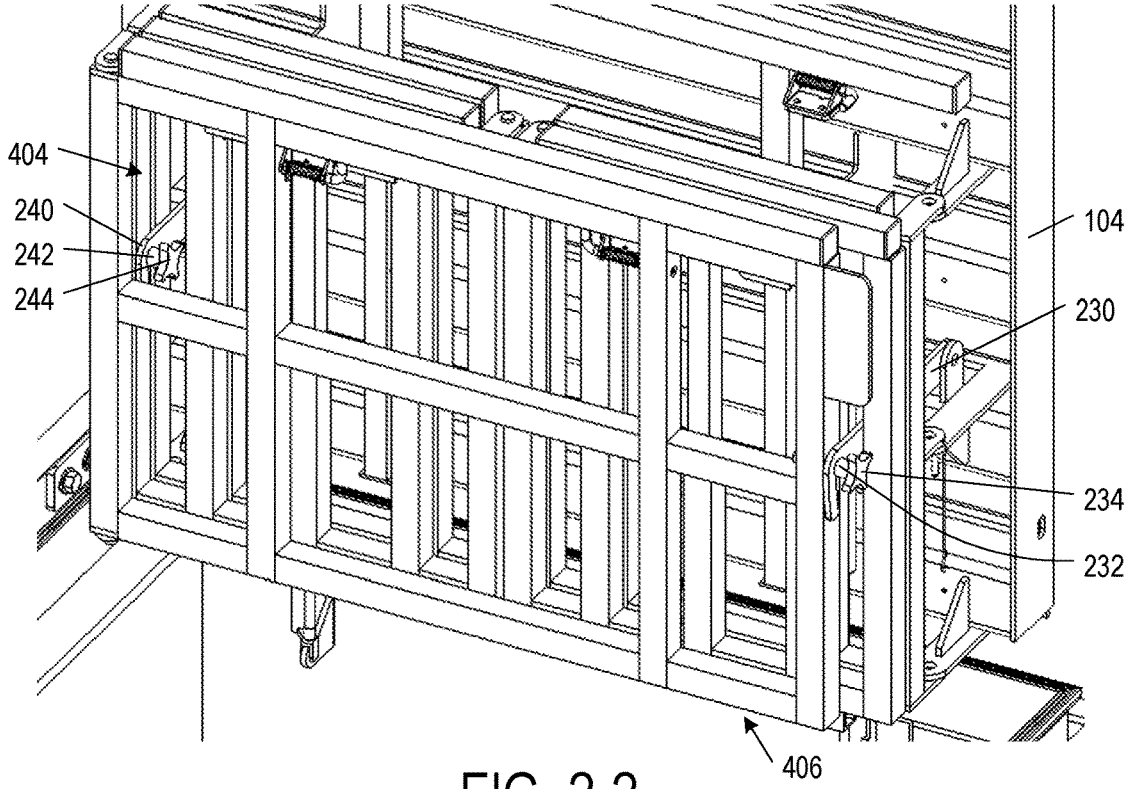

Referring to FIG. 2-1, underground enclosure 100 includes a body 202 defining a top access opening 204. Body 202 is typically a precast concrete structure consisting of one or more components. Although access opening 204 is shown as the open top of body 202, access opening 204 may be an opening in a top section of body 202 or a riser fitted to such opening.

Hatch frame 102 and hatch cover 104 form a hatch for access opening 204. Hatch frame 102 is fixed around access opening 204 by concrete (cast in), fasteners, or equivalent means. Referring to the orientation in FIG. 2-1. hatch cover 104 is pivotally connected at its lower edge to an upper edge of hatch frame 102 by hinges or equivalent means. A lifting mechanism (e.g., one or more gas struts or springs) may be provided to assist the opening and closing of hatch cover 104.

FIG. 2-1 shows hatch cover 104 swung to a vertical or near vertical position. Referring to the orientation in FIG. 2-1, a folding safety railing 206 is pivotally connected to a left side of hatch cover 104 while a folding safety railing 208 is pivotally connected to a right side of hatch cover 104. In their folded state, folding safety railings 206 and 208 rest against hatch cover 104.

Figures 2, 3:
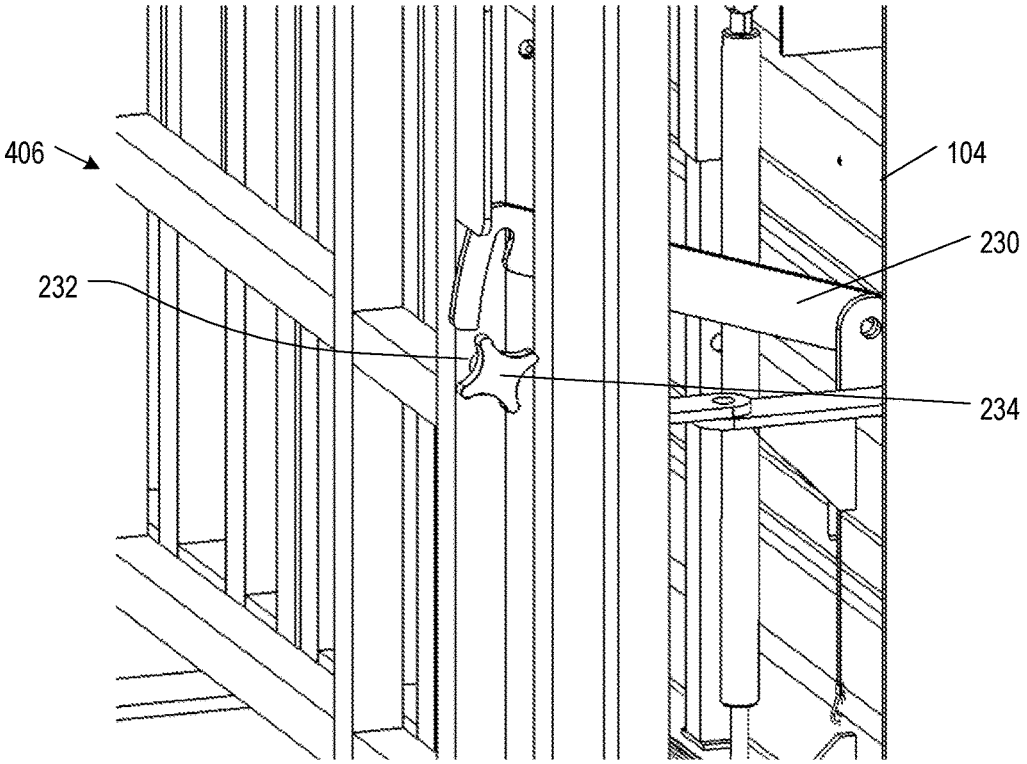
Figure 3:
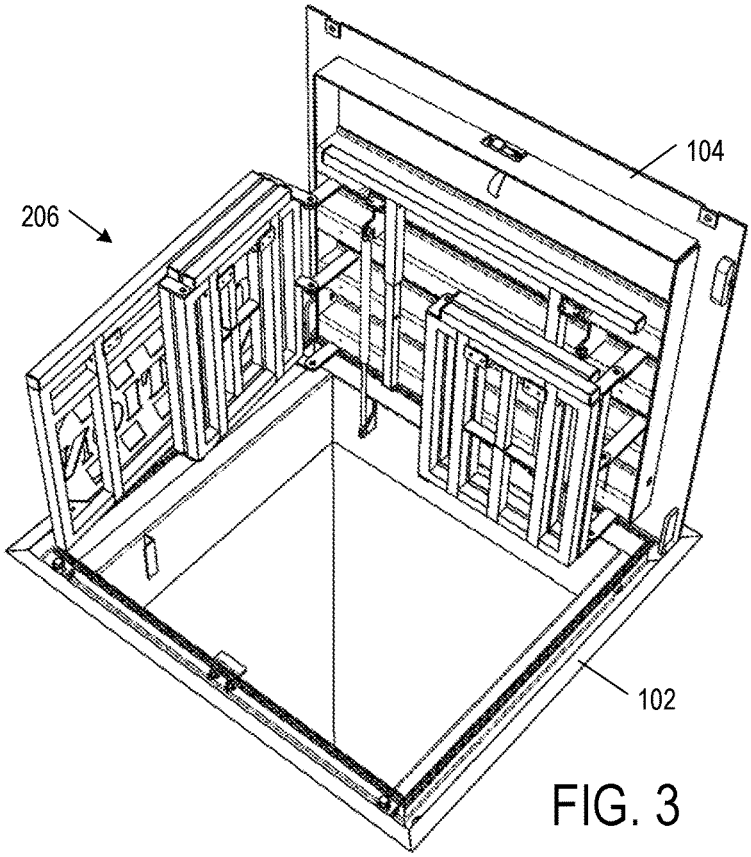

FIGS. 2-2 and 2-3 are partial views that show latching mechanisms to secure folding safety railings 206 and 208 (FIG. 2-1) rest against hatch cover 104. Referring to the orientation of FIGS. 2-2 and 2-3, a latch 230 is pivotally connected to the right side of hatch cover 104. Latch 230 swings down to hook onto a latch bar 232 fixed to the right side of a panel 406 (more clearly illustrated in FIG. 4) of folding safety railing 206. A nut 234 on latch bar 232 may be turned clockwise to lock latch 230 on latch bar 232 or counterclockwise to release latch 230 from latch bar 232. A latch 240 is pivotally connected to the left side of hatch cover 104. Latch 240 swings down to hook onto a bar 242 fixed to the left side of a panel 404 (more clearly illustrated in FIG. 4) of folding safety railing 206. A nut 244 on latch bar 242 may be turned clockwise to lock latch 240 onto latch bar 242 or counterclockwise to release latch 240 from latch bar 242. As panel 406 of folding safety railing 206 extends over folding safety railing 208, securing folding safety railing 206 also secures folding safety railing 208.

Figure 4:
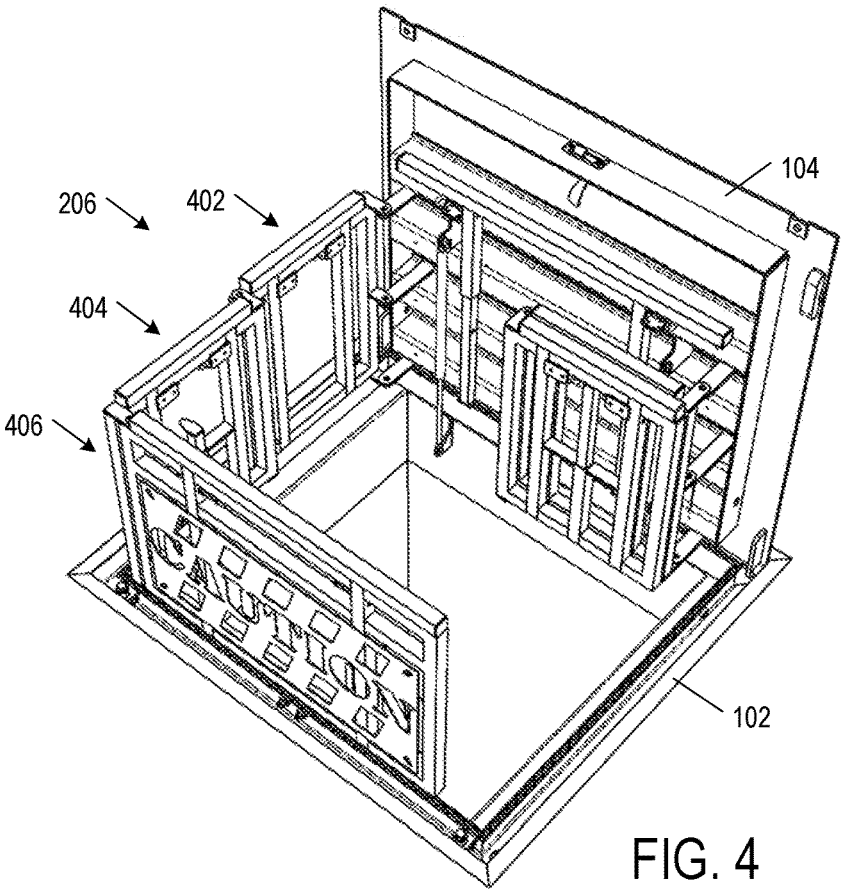

FIGS. 3 and 4 shows folding safety railing 206 being unfolded. Folding safety railing 206 includes panels 402, 404, and 406 (FIG. 4) that are linked in series by hinges or equivalent means. Each panel has a frame construction consisting of upright and cross tubes, such as outer upright tubes, upright (slide) tubes between the outer upright tubes, and cross tubes joining the upright tubes. A panel may include infills between the tubes, such as bars, mesh, or louvers, or a panel may be covered by sheet metal.

Panel 402 is pivotally connected at a vertical edge to the left side of hatch cover 104 by hinges or equivalent means, panel 404 is pivotally connected to another vertical edge of panel 402, and panel 406 is pivotally connected to panel 404. A hinge may consist of a pivot plate and gusset fixed to the outer upright tube of a panel, a mount plate and gusset fixed to hatch cover 104 or the outer upright tube of another panel, and a pin passing through holes defined in the pivot and mount plates.

Referring to the orientation of FIGS. 3 and 4, panel 402 swings open clockwise from a vertical or near vertical hatch cover 104 and then panel 404 swings open counterclockwise from panel 402 so panels 402 and 404 stand vertically along a left edge of hatch frame 102. Panel 406 then swings open clockwise from panel 404 so panel 406 stands vertically along a lower edge of hatch frame 102.

Figure 5:
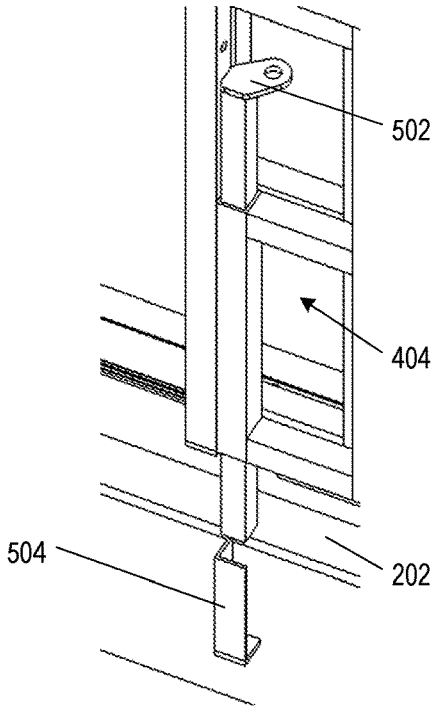

FIG. 5 is a partial view that shows a drop bolt 502 (also referred to as a "kick stand") that is extendable into an L-shaped socket 504, which is fixed to body 202 (or hatch frame 102), to lock folding safety railing 206 (FIG. 4) in its unfolded state. Drop bolt 502 may be located on one or more panels, such as panels 404 and 406. Drop bolt 502 may be a tube located in an upright slide tube of panel 404. Drop bolt 502 may include a top lift tab for easy handling.

Figure 6:
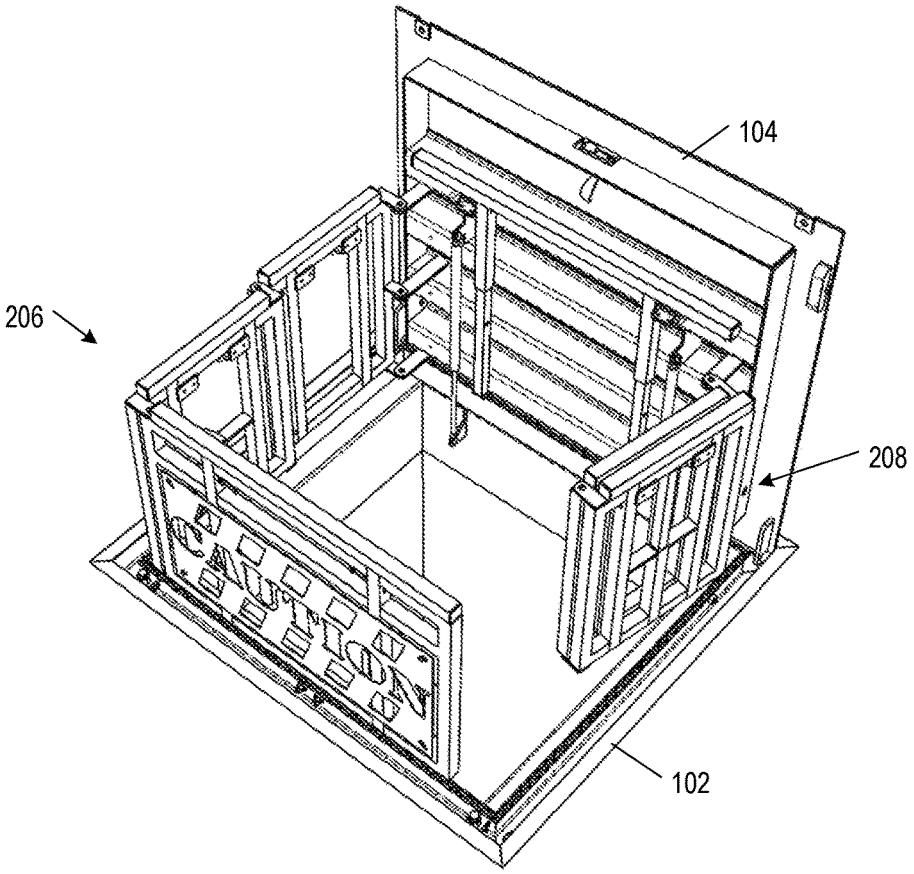
Figure 7:
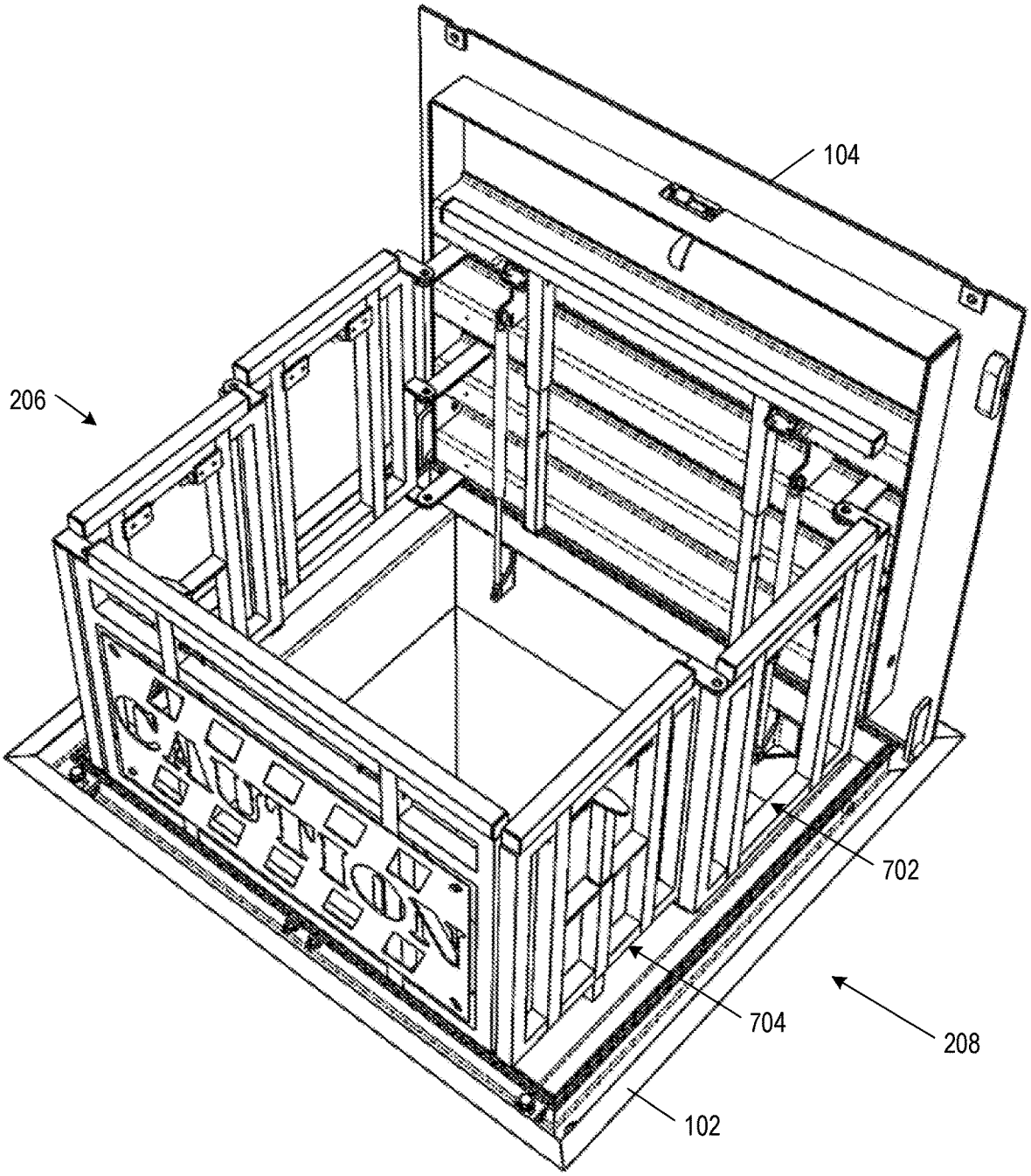

FIGS. 6 and 7 show folding safety railing 208 being unfolded. Folding safety railing 208 includes panels 702 and 704 (FIG. 7) that are linked in series by hinges or equivalent means. Referring to the orientation in FIGS. 6 and 7, panel 702 is pivotally connected at one vertical edge to the right side of hatch cover 104 by hinges or equivalent means, and panel 704 is pivotally connected to another vertical edge of panel 702. Panel 702 swings open counterclockwise from a vertical or near vertical hatch cover 104 and then panel 704 swings clockwise from panel 702 so panels 702 and 704 stand vertically along a right edge of hatch frame 102. As previously described, a drop bolt 502 (FIG. 5) may be located on one or more panels, such as panel 704 (FIG. 4), to lock folding safety railing 208 in its unfolded state.

Figure 8:
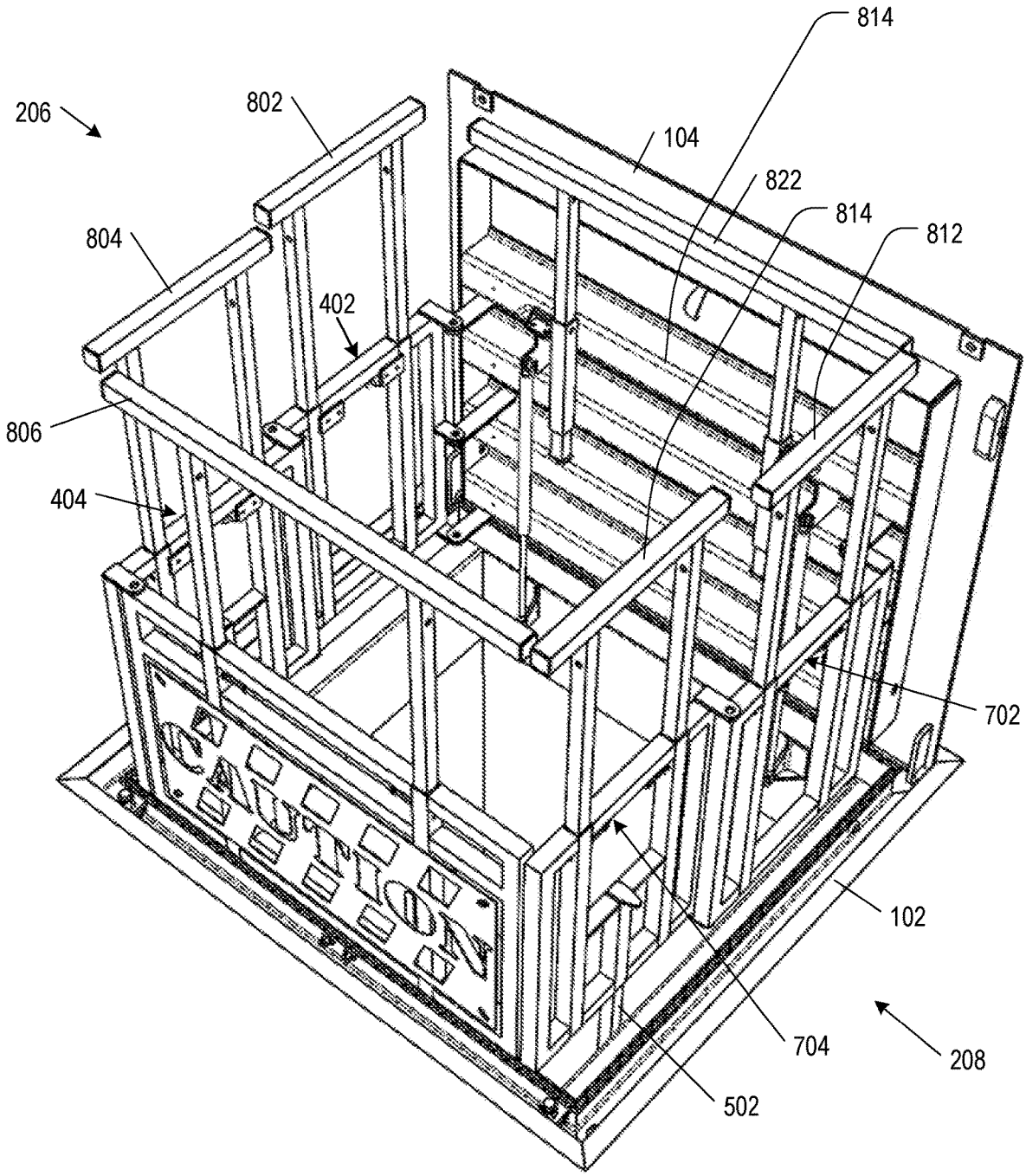

FIG. 8 shows folding safety railing 206 further includes extensions 802, 804, and 806 that are extendable from panels 402, 404, and 406, respectively, to increase the height of folding safety railing 206. Similarly, folding safety railing 208 further includes extensions 812 and 814 that are extendable from panels 702 and 704, respectively, to increase the height of folding safety railing 208.

Each extension consists of a top horizontal handrail fixed to upright slide tubes, which telescope from upright slide tubes of a corresponding panel. Each panel includes spring latches that are extendable through holes in the tubes to lock a corresponding extension in a raised or lowered position.

An extension 822 may also be provided for hatch cover 104 when its height is too low to act as a safety railing. Extension 822 may telescope from upright slide tubes fixed to hatch cover 104.

Figure 9:
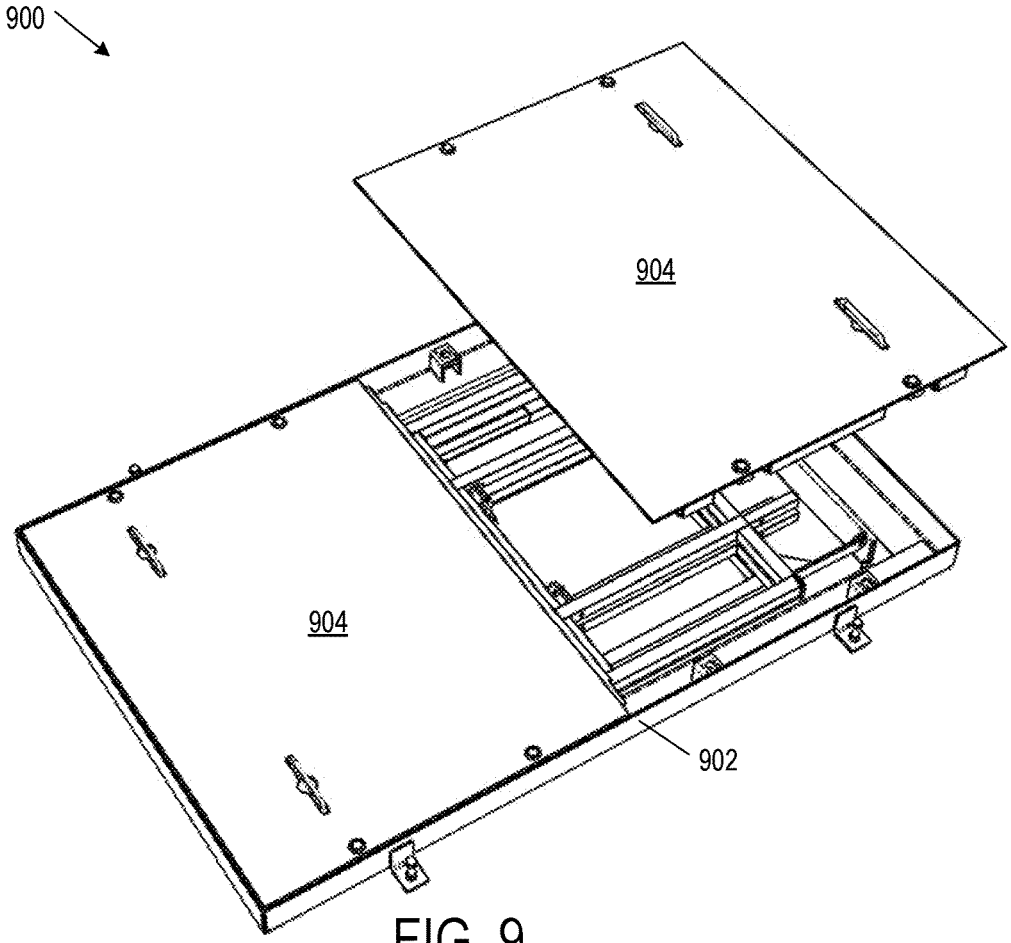
FIG. 9 is a perspective view of an underground enclosure having a hatch frame and a hatch cover in the hatch frame in some examples of the present disclosure.

FIG. 9 is a perspective view of an underground enclosure 900 in some examples of the present disclosure. Underground enclosure 900 includes a hatch frame 902 and one or more hatch covers 904, which together form a hatch for an access opening of underground enclosure 900. Underground enclosure 900 is like underground enclosure 100 (FIG. 1) except that hatch covers 904 are drag-off covers, which are not pivotally connected to hatch frame 902. Thus, the later described folding safety railings are pivotally connected to hatch frame 902 instead of hatch covers 904.

Figures 1, 10:
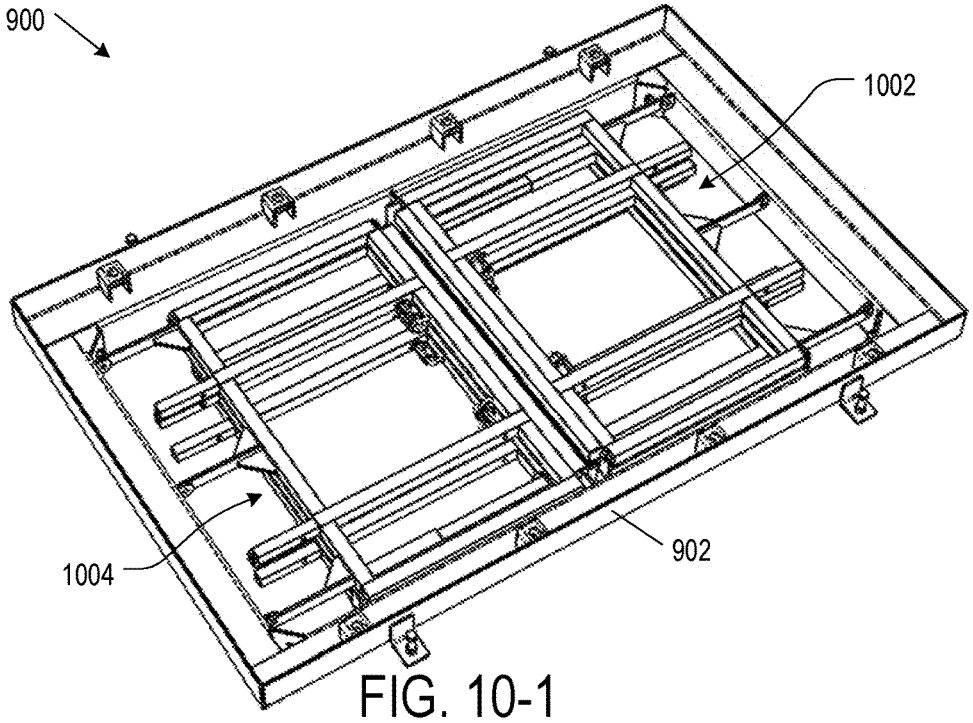
Figures 2, 10:
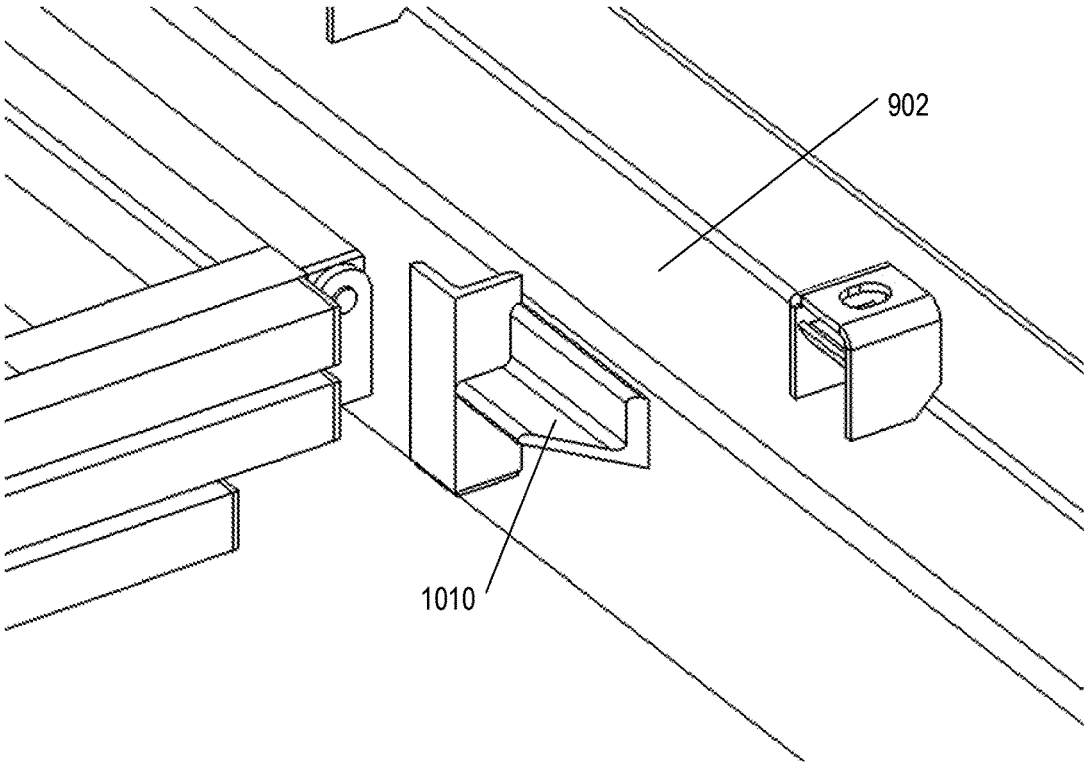
Figures 3, 10:
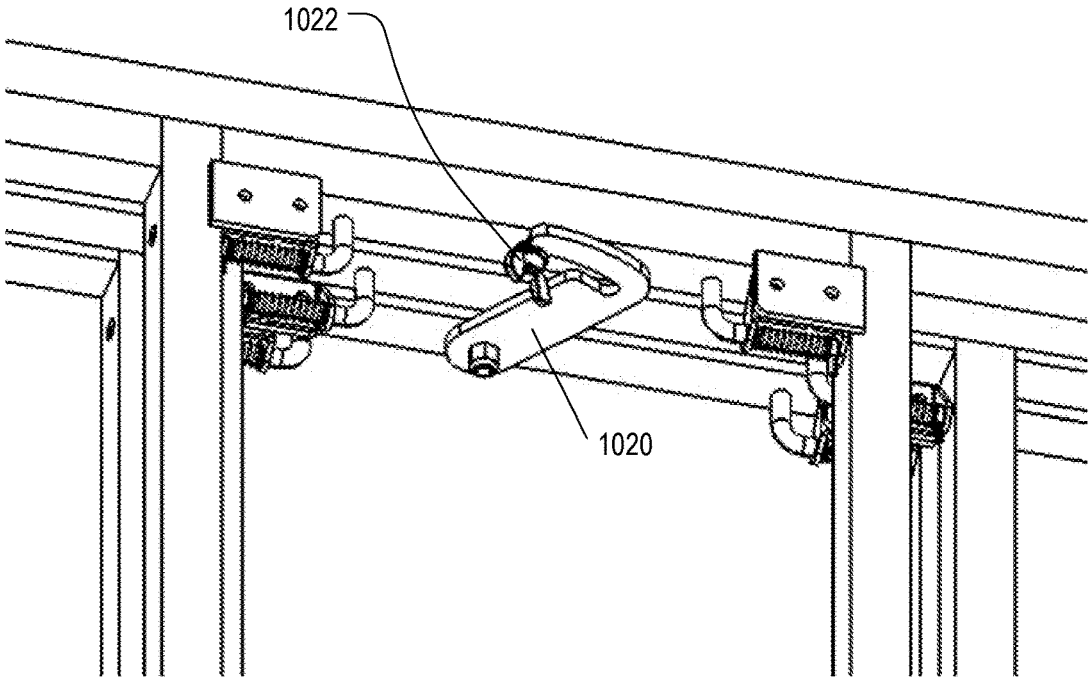
Figure 15:
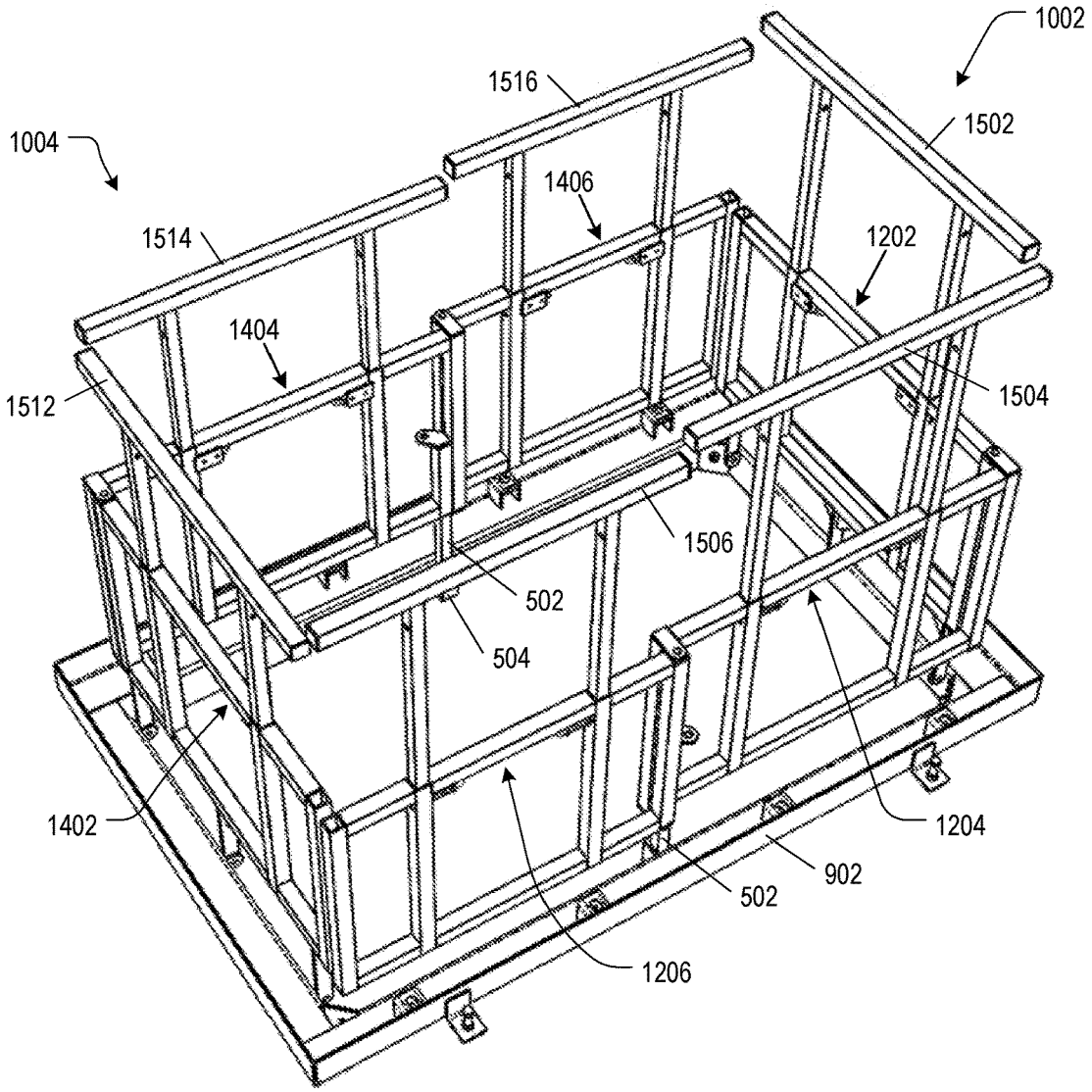

FIGS. 10-1 to 15 are perspective views illustrating the operation of a safety railing system for underground enclosure 900 in some examples of the present disclosure.

FIG. 10-1 shows underground enclosure 900 after removing hatch covers 904 (FIG. 9). Referring to the orientation in FIG. 10, a folding safety railing 1002 is pivotally connected to a right (short) side of hatch frame 902 while a folding safety railing 1004 is pivotally connected to a left (short) side of hatch cover 104.

FIGS. 10-2 is a partial view that shows folding safety railings 1002 and 1004 (FIG. 10-1), in their folded state, rest horizontally on supports 1010 (only one is shown) fixed to hatch frame 902. FIG. 10-3 is a partial view that shows a latching mechanism for securing folding safety railing 1002 or 1004 in its folded state. A latch 1020 is pivotally connected one of the panels of a folding safety railing. Latch 1020 swings down to hook onto a bar (not visible) fixed to another panel of the same folding safety railing. A nut 1022 on the latch bar may be turned clockwise to lock latch 1020 on the latch bar or counterclockwise to release latch 1022 from the latch bar.

Figure 11:
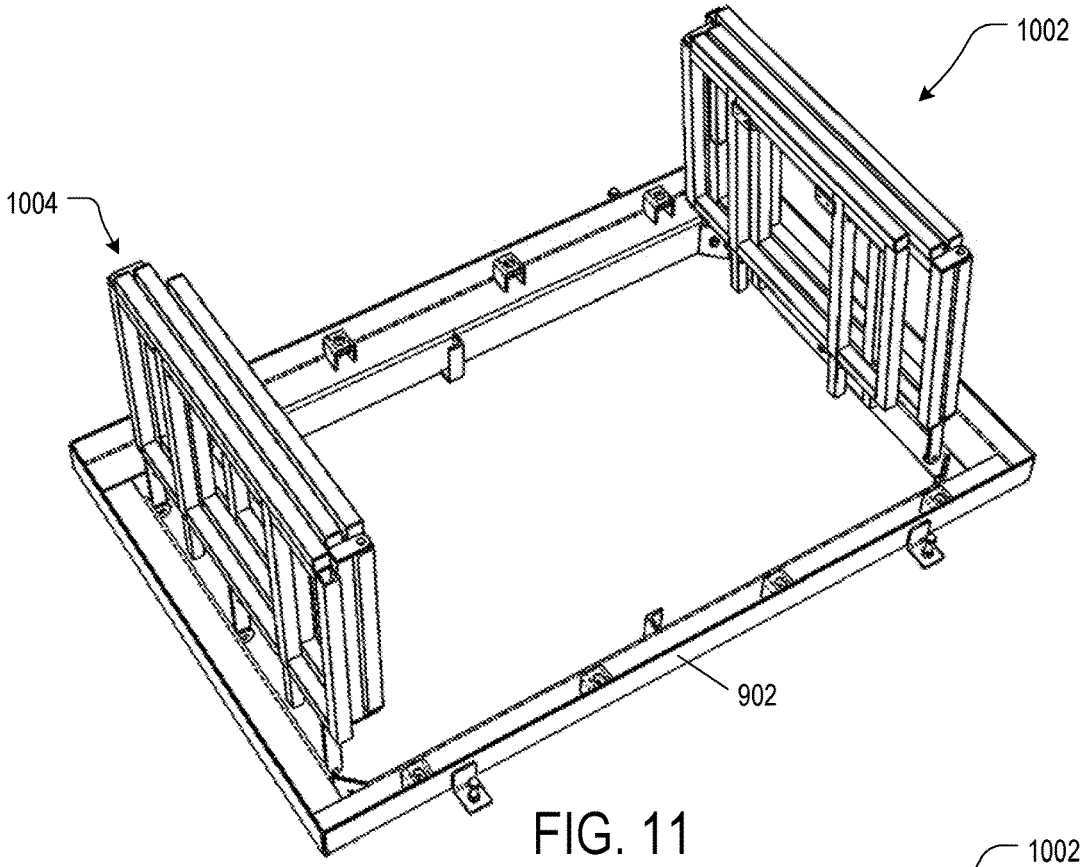
Figure 12:
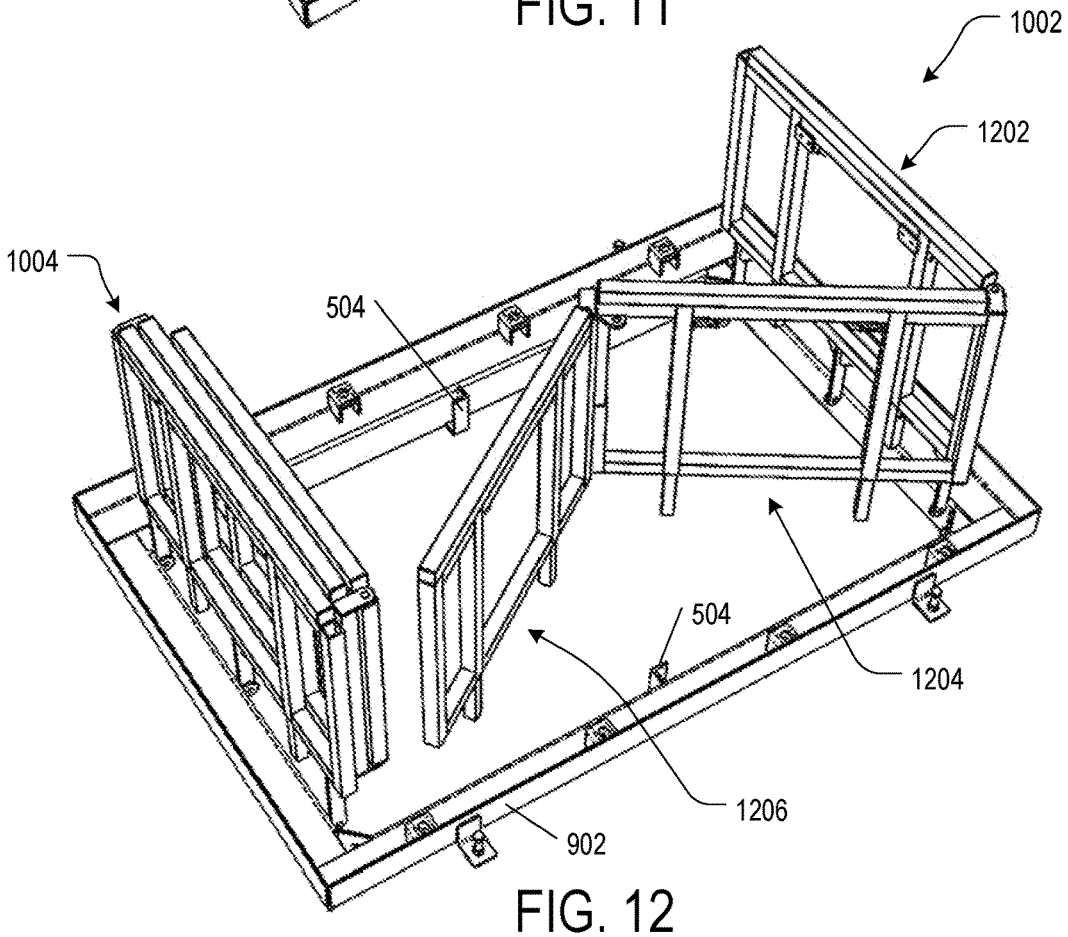
Figure 13:
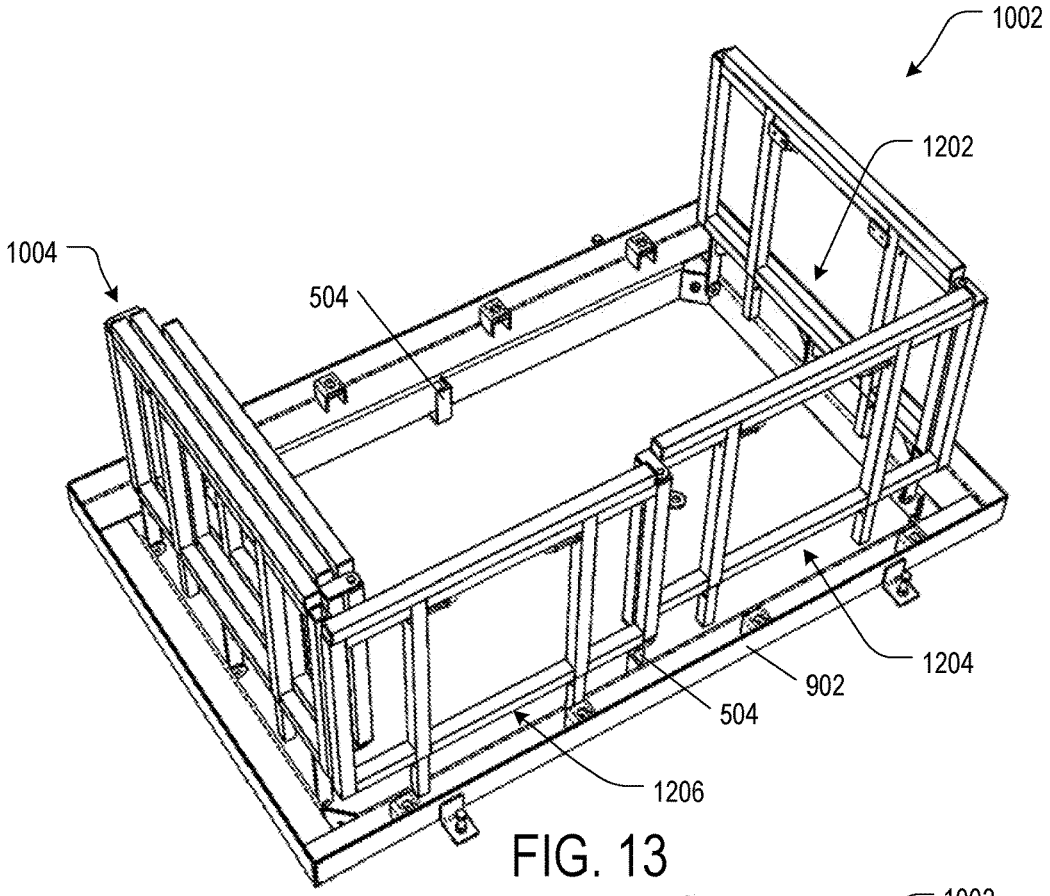

FIGS. 11, 12, and 13 show folding safety railing 1002 being unfolded. Folding safety railing 1002 includes panels 1202, 1204, and 1206 that are linked in series by hinges or equivalent means. Each panel has a frame construction composed of upright and cross tubes. A panel may include infills, such as bars, mesh, or louvers, or a panel may be covered by sheet metal.

Referring to the orientation in FIGS. 11 to 13, panel 1202 is pivotally connected at a lower horizontal edge to a right (short) side of hatch frame 902 by hinges or equivalent means, panel 1204 is pivotally connected to a vertical (perpendicular) edge of panel 1202, and panel 1206 is pivotally connected to panel 1204. As shown in FIG. 11, panel 1202 swings open upward from hatch frame 902 so panels 1202, 1204, and 1206 are oriented vertically along the right edge of hatch frame 902. Referring to FIGS. 12 and 13, panel 1204 swings open counterclockwise from panel 1202 and then panel 1206 swings open clockwise from panel 1204 so panels 1204 and 1206 stand vertically along a lower (long) edge of hatch frame 902.

A drop bolt 502 (FIG. 13) may be located on one or more panels, such as panel 1204. Drop bolt 502 may be extended into a socket 504 (FIG. 12), which is fixed to hatch frame 902, to lock folding safety railing 1002 in its unfolded state.

Figure 14:
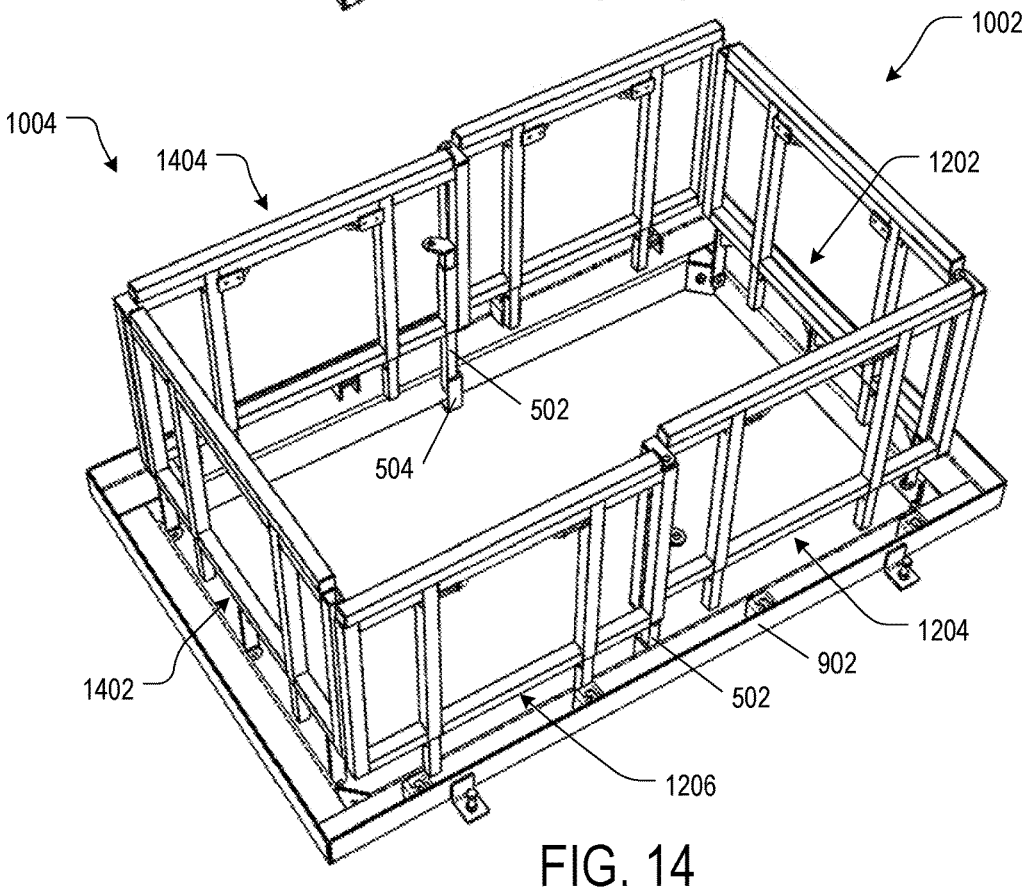

FIG. 14 shows folding safety railing 1004 being unfolded. Folding safety railing 1004 includes panels 1402, 1404, and 1406 that are like panels 1202, 1204, and 1206 (FIG. 12). Referring to the orientation in FIG. 14, panel 1402 is pivotally connected at a lower horizontal edge to a left (short) side of hatch frame 902 by hinges or equivalent means, panel 1404 is pivotally connected to a vertical (perpendicular) edge of panel 1402, and panel 1406 is pivotally connected to panel 1404. Panel 1402 swings open upward from hatch frame 902 so panels 1402, 1404, and 1406 are oriented vertically along the left edge of hatch frame 902. Panel 1404 swings open counterclockwise from panels 1402 and then panel 1406 swings open clockwise from panel 1404 so panels 1404 and 1406 stand vertically along an upper (long) edge of hatch frame 902.

A drop bolt 502 may be located on one or more panels, such as panel 1404. Drop bolt 502 may be extended into a socket 504, which is fixed to hatch frame 902, to lock folding safety railing 1004 in its unfolded state. In the locked and unfolded state of folding safety railings 1002 and 1004, a free end of panel 1206 may abut against panel 1402 and a free end of panel 1406 may abut against panel 1202.

FIG. 15 shows folding safety railing 1002 further includes extensions 1502, 1504, and 1506 that are extendable from panels 1202, 1204, and 1206, respectively, to increase the height of folding safety railing 1002. Similarly, folding safety railing 1004 further includes extensions 1512, 1514, and 1516 that are extendable from panels 1402, 1404, and 1406, respectively, to increase the height of folding safety railing 1004.

Each extension consists of a top horizontal handrail connected to upright slide tubes, which telescope from upright tubes of a corresponding panel. Each panel may include spring latches extendable through holes in the slide tubes to lock a corresponding extension in a raised or lowered position.

Figure 16:
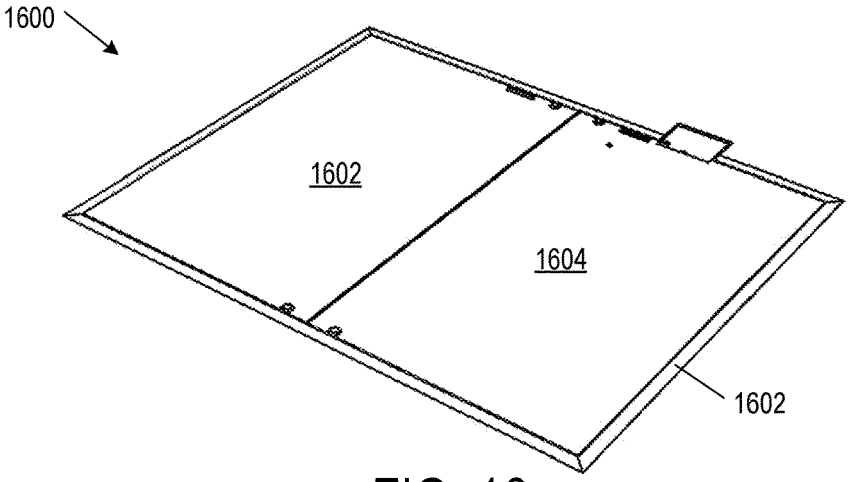
FIG. 16 is a perspective view of an underground enclosure having a hatch frame and a hatch cover in the hatch frame in some examples of the present disclosure.

FIG. 16 is a perspective view of an underground enclosure 1600 in some examples of the present disclosure. Underground enclosure 1600 includes a hatch frame 1602 and two hatch covers 1604 and 1606, which together form a hatch for an access opening of underground enclosure 1600. Underground enclosure 1600 is like underground enclosure 100 (FIG. 1) except underground enclosure 1600 includes two hatch covers 1604 and 1606. Referring to the orientation in FIG. 16, hatch cover 1604 is pivotally connected at its lower edge to a right (short) edge of hatch frame 1602 by hinges or equivalent means, and hatch cover 1606 is pivotally connected at its lower edge to a left (short) edge of hatch frame 1602 by hinges or equivalent means. Lifting mechanisms (e.g., one or more gas struts or springs) may be provided to assist the opening and closing of hatch covers 1604 and 1606.

FIGS. 17 to 20 are perspective views illustrating the operation of a safety railing system for underground enclosure 1600 in some examples of the present disclosure.

Figure 17:
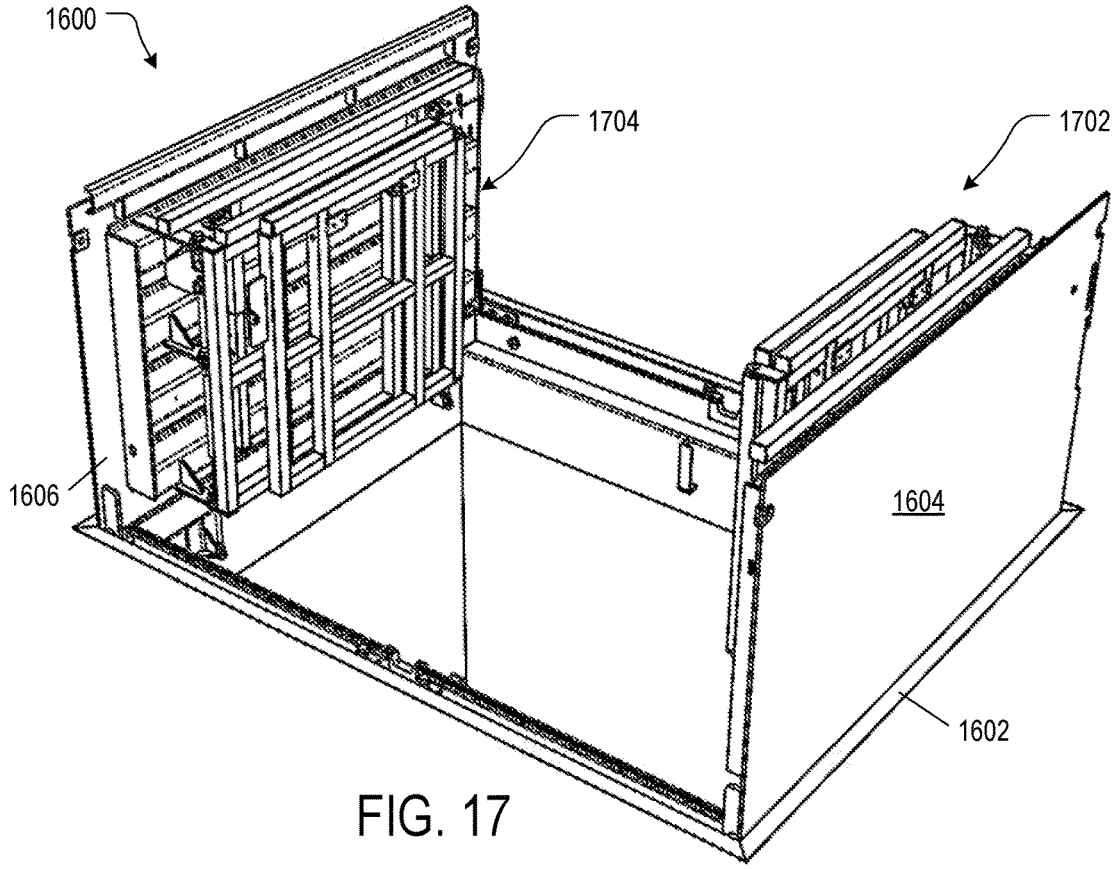
FIGS. 17, 18, 19, and 20 are perspective views illustrating the operation of a safety railing system for the underground enclosure of FIG. 16 in some examples of the present disclosure.

FIG. 17 shows hatch covers 1604 and 1606 swung to vertical or near vertical positions. Referring to the orientation in FIG. 17, a folding safety railing 1702 is pivotally connected to hatch cover 1604 while a folding safety railing 1704 is pivotally connected to hatch cover 1606. In their folded state, folding safety railings 1702 and 1704 rest against respective hatch covers 1604 and 1606. Similar latching mechanisms as shown in FIGS. 2-2 and 2-3 are used to secure folding safety railings 1702 and 1704 against hatch cover 1604 and 1606, respectively.

Figure 18:
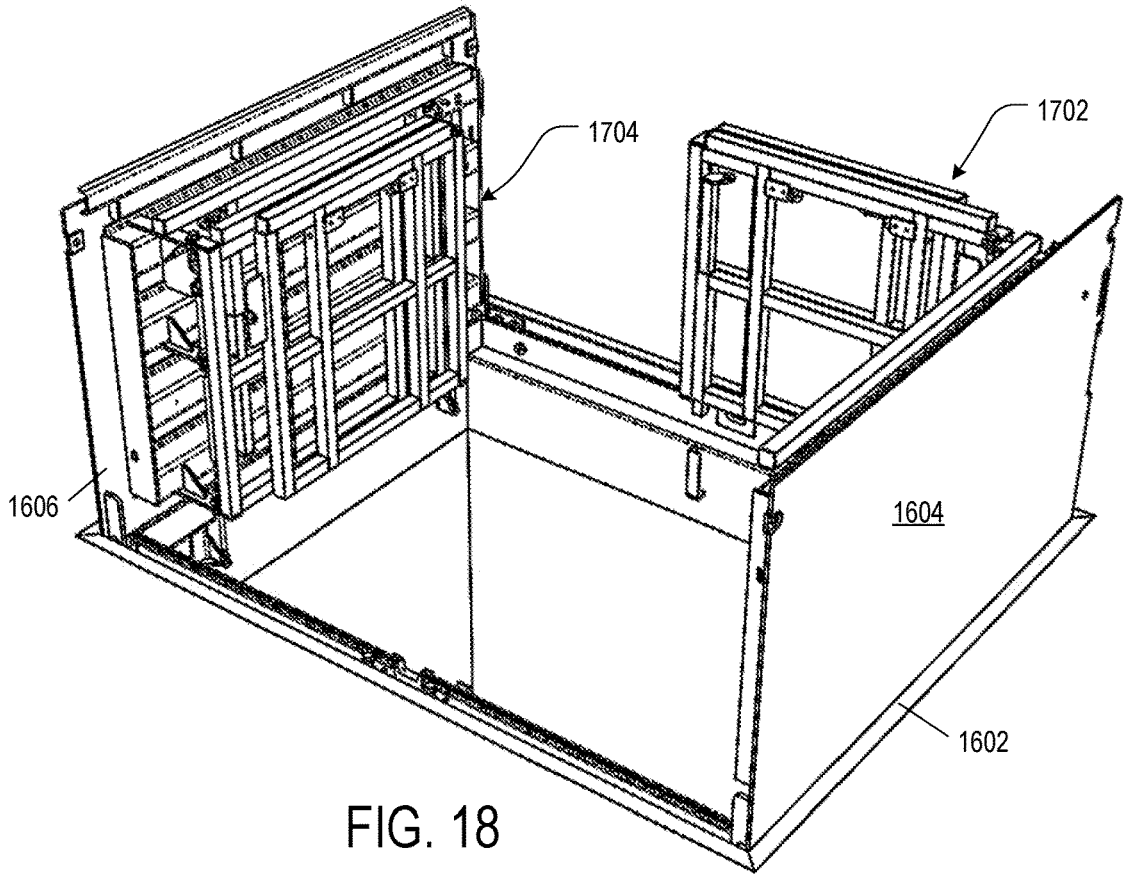
Figure 19:
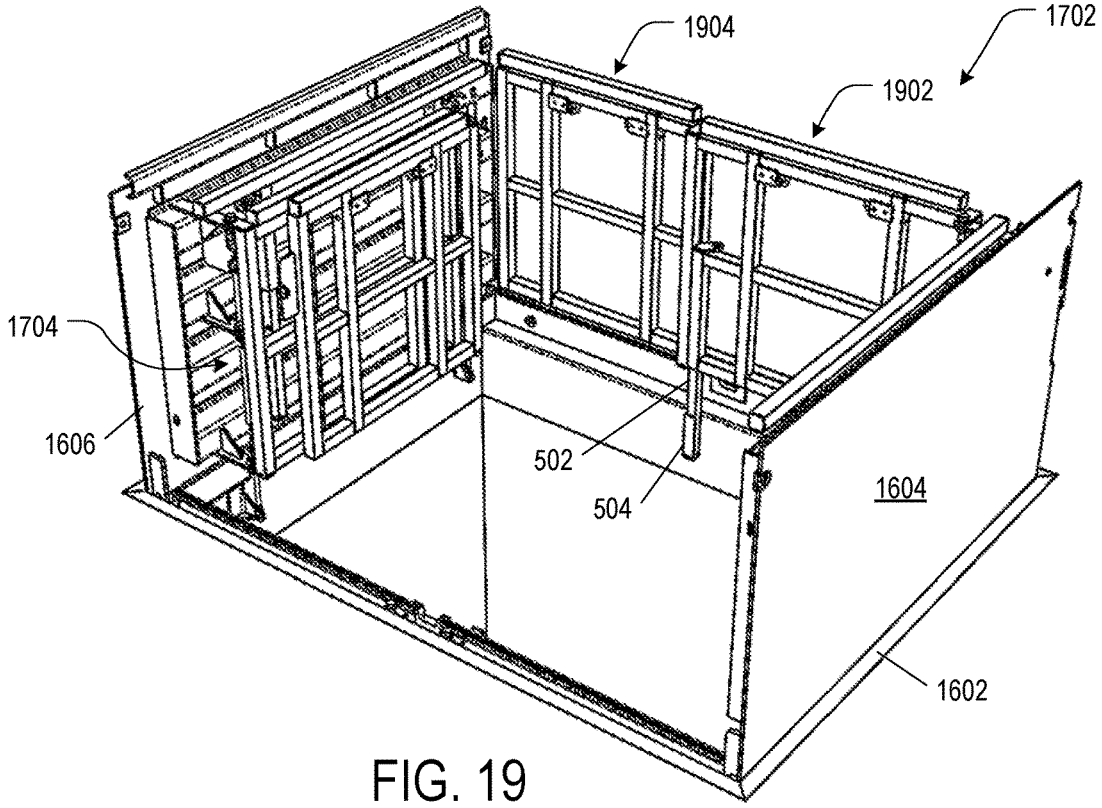

FIGS. 18 and 19 show folding safety railing 1702 being unfolded. Folding safety railing 1702 includes panels 1902 and 1904 (FIG. 19) that are linked in series by hinges or equivalent means. Each panel has a frame construction composed of upright and cross tubes. A panel may include infills, such as bars, mesh, or louvers, or a panel may be covered by sheet metal.

Referring to the orientation of FIGS. 18 and 19, panel 1902 is pivotally connected at a vertical edge to the right side of hatch cover 1604 by hinges or equivalent means, and panel 1904 is pivotally connected to another vertical (parallel) edge of panel 1902. Panel 1902 swings open clockwise from a vertical or near vertical hatch cover 1604 and then panel 1904 swings open counterclockwise from panel 1902 so panels 1902 and 1904 stand vertically along an upper (long) edge of hatch frame 1602.

Figure 20:
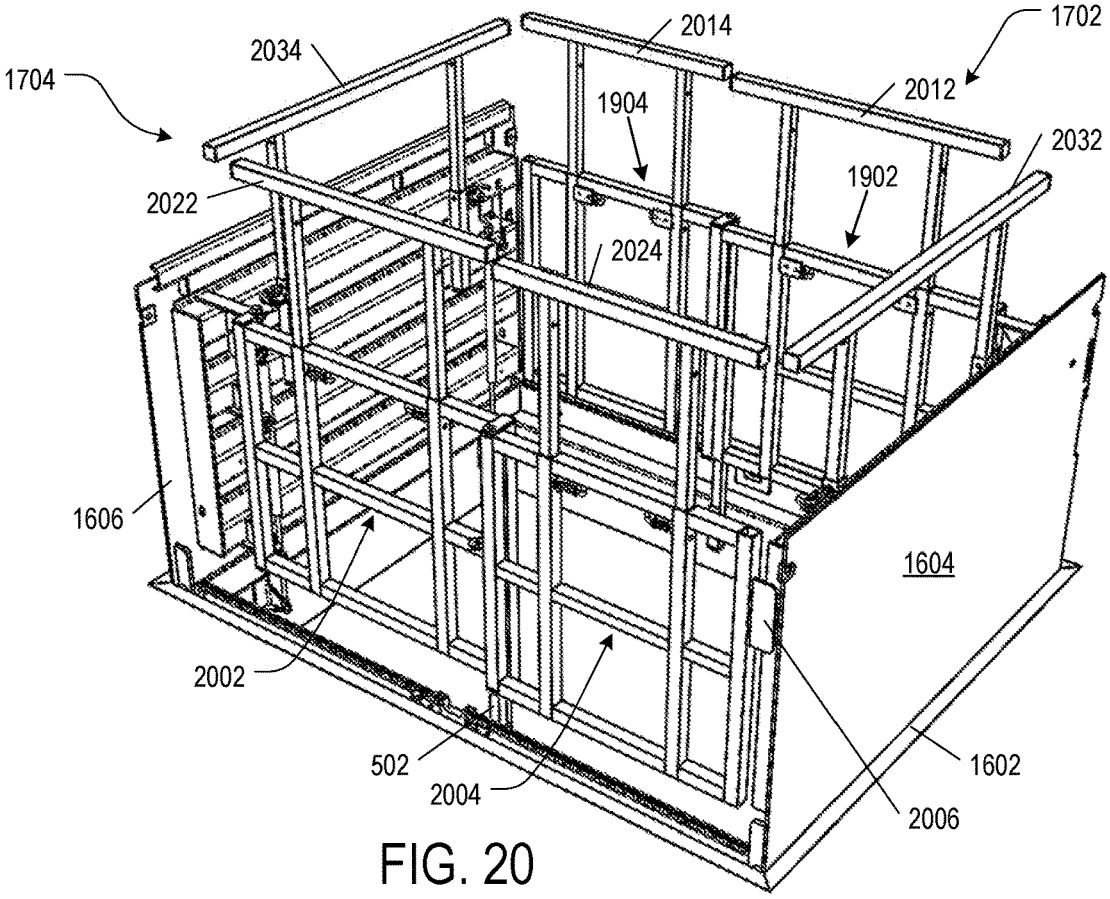

FIG. 20 shows folding safety railing 1704 being unfolded. Referring to the orientation of FIG. 20, panel 2002 is pivotally connected at a vertical edge to the left side of hatch cover 1606 by hinges or equivalent means, and panel 2004 is pivotally connected to another vertical (parallel) edge of panel 2002. Panel 2002 swings open clockwise from a vertical or near vertical hatch cover 1606 and then panel 2004 swings open counterclockwise from panel 2002 so panels 2002 and 2004 stand vertically along a lower (long) edge of hatch frame 1602.

Drop bolts 502 may be located on the panels, such as panels 1902 and 2002. Drop bolts 502 may be extended into sockets 504, which are fixed to hatch frame 1602, to lock folding safety railings 1702 and 1704 in their unfolded state. In the locked state, a stop plate (not visible) on a free end of panel 1904 may abut against and be latched by its lock tab to the right side of hatch cover 1606, and a stop plate 2006 on a free end of panel 2004 may abut against and be latched by its lock tab (not visible) to the left side of hatch cover 1604.

Folding safety railing 1702 further includes extensions 2012 and 2014 that are extendable from panels 1902 and 1904, respectively, to increase the height of folding safety railing 1702. Similarly, folding safety railing 1704 further includes extensions 2022 and 2024 that are extendable from panels 2002 and 2004, respectively, to increase the height of folding safety railing 208.

Each extension consists of a top horizontal handrail connected to upright slide tubes, which telescope from upright tubes of a corresponding panel. Each panel may include spring latches extendable through holes in the slide tubes to lock a corresponding extension in a raised or lowered position.

Extensions 2032 and 2034 may be provided for hatch covers 1604 and 1606, respectively, when their height is too low to act as a safety railing. Extensions 2032 and 2034 may telescope from upright slide tubes fixed to hatch covers 1604 and 1606.

Figure 21:
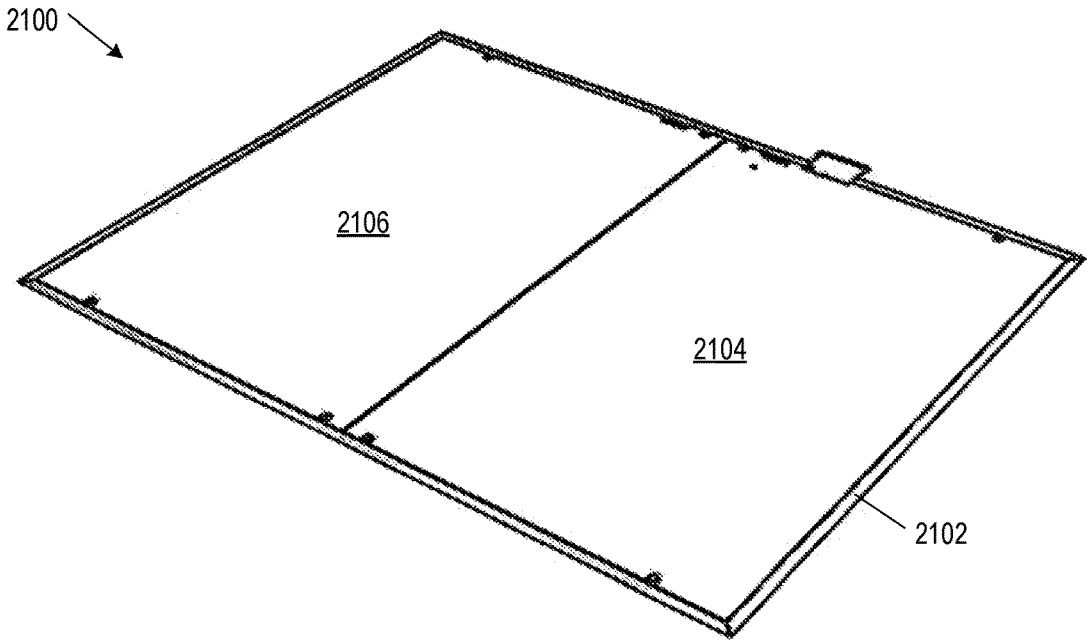
FIG. 21 is a perspective view of an underground enclosure having a hatch frame and a hatch cover in the hatch frame in some examples of the present disclosure.

FIG. 21 is a perspective view of an underground enclosure 2100 in some examples of the present disclosure. Underground enclosure 2100 is like underground enclosure 1600 (FIG. 16). Underground enclosure 2100 includes a hatch frame 2102 and two hatch covers 2104 and 2106, which together form a hatch for an access opening of underground enclosure 2100.

Figure 22:
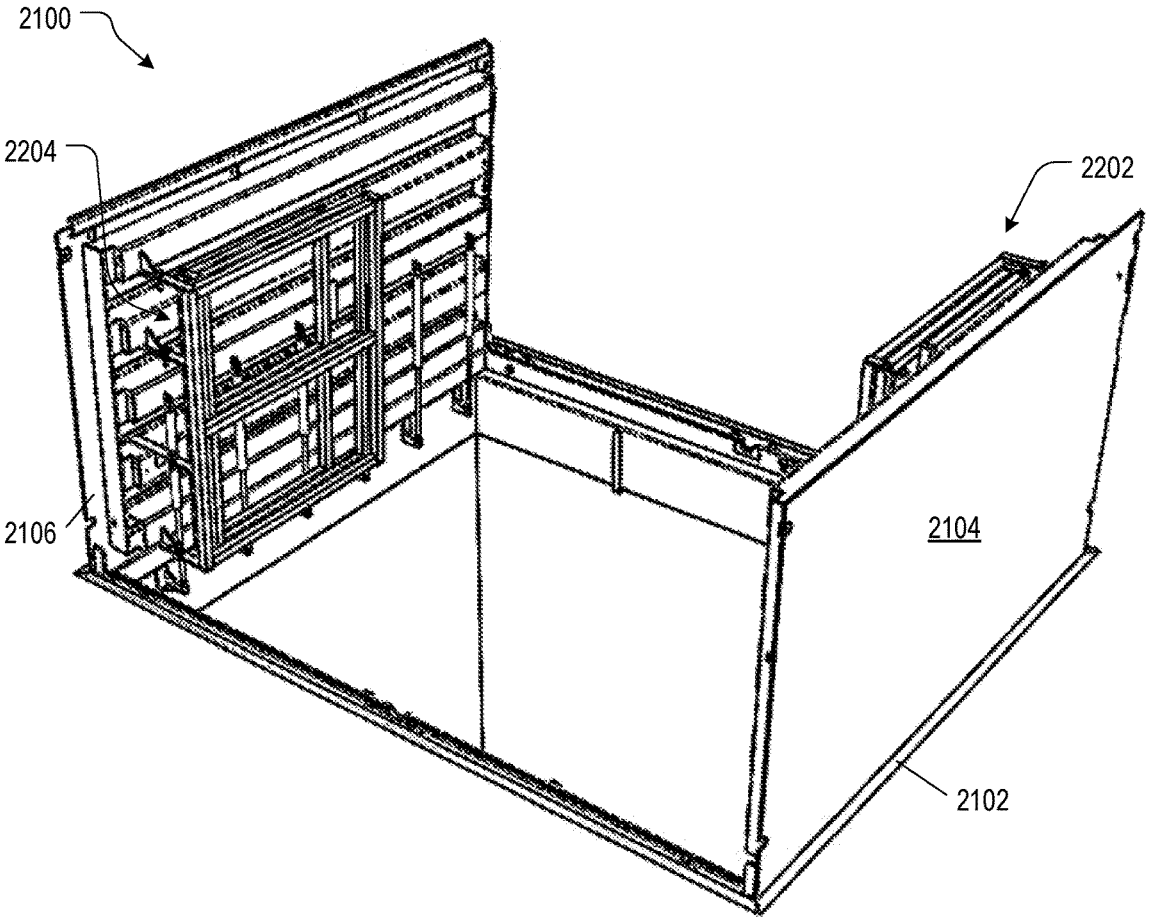
FIGS. 22, 23, and 24 are perspective views illustrating the operation of a safety railing system for the underground enclosure of FIG. 21 in some examples of the present disclosure.
Figure 23:
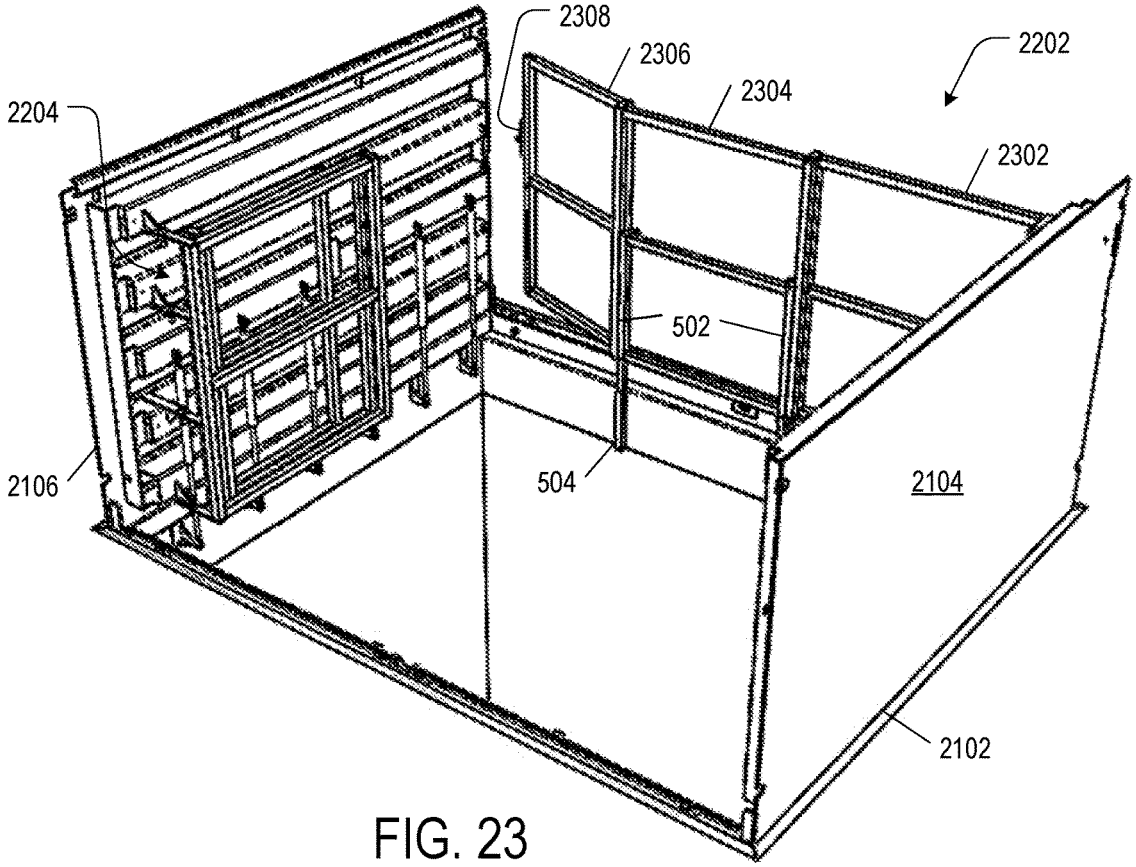
Figure 24:
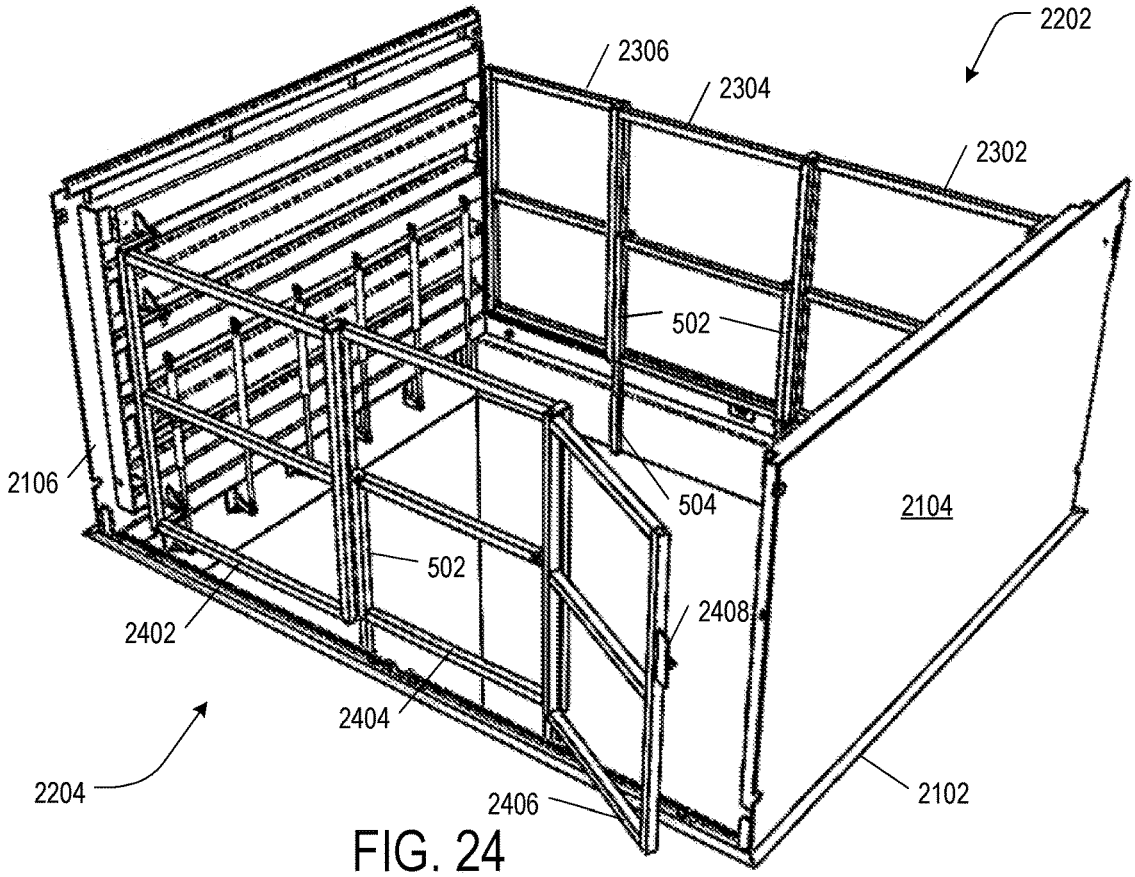

FIGS. 22 to 24 are perspective views illustrating the operation of a safety railing system for underground enclosure 2100 in some examples of the present disclosure.

Referring to the orientation in FIG. 22, hatch cover 2104 is pivotally connected at its lower edge to a right (short) edge of hatch frame 2102 by hinges or equivalent means, and hatch cover 2106 is pivotally connected at its lower edge to a left (short) edge of hatch frame 2102 by hinges or equivalent means. Lifting mechanisms (e.g., one or more gas struts or springs) may be provided to assist the opening and closing of hatch covers 2104 and 2106.

FIG. 22 shows hatch covers 2104 and 2106 swung to vertical or near vertical positions. A folding safety railing 2202 is pivotally connected to hatch cover 2104 while a folding safety railing 2204 is pivotally connected to hatch cover 2106. In their folded state, folding safety railings 2202 and 2204 rest against respective hatch covers 2104 and 2106. Similar latching mechanisms as shown in FIGS. 2-2 and 2-3 are used to secure folding safety railings 2202 and 2204 against hatch cover 2104 and 2106, respectively.

FIGS. 23 and 24 show folding safety railings 2202 and 2204 being unfolded. Folding safety railing 2202 is like folding safety railing 1702 (FIG. 19) but includes three panels 2302, 2304, and 2306 that are linked in series by hinges or equivalent means and do not have any extensions. Folding safety railing 2204 is like folding safety railing 1704 (FIG. 20) but includes three panels 2402, 2404, and 2406 (FIG. 24) that are linked in series by hinges or equivalent means and do not have any extensions. Each panel has a frame construction composed of upright and cross tubes. A panel may include infills, such as bars, mesh, or louvers, or a panel may be covered by sheet metal.

Referring to the orientation of FIGS. 23 and 24, panel 2302 is pivotally connected at a vertical edge to the right side of hatch cover 2104 by hinges or equivalent means, panel 2304 is pivotally connected to another vertical (parallel) edge of panel 2302, and panel 2306 is pivotally connected to panel 2304. Panel 2302 swings open clockwise from a vertical or near vertical hatch cover 2104, panel 2304 swings open clockwise from panel 2302, and panel 2306 swing open counterclockwise from panel 2304 so panels 2302, 2304, and 2306 stand vertically along an upper (long) edge of hatch frame 2102.

Panel 2402 is pivotally connected at a vertical edge to the left side of hatch cover 2106 by hinges or equivalent means, panel 2404 is pivotally connected to another vertical (parallel) edge of panel 2402, and panel 2406 is pivotally connected to panel 2404. Panel 2402 swings open clockwise from a vertical or near vertical hatch cover 2106, panel 2404 swings open clockwise from panel 2402, and panel 2406 swings open counterclockwise from panel 2404 so panels 2402, 2404, and 2406 stand vertically along a lower (long) edge of hatch frame 2102.

Drop bolts 502 may be located on the panels, such drop bolts 502 on panels 2304 and 2404. Drop bolts 502 may be extended into sockets 504, which are fixed to hatch frame 2102, to lock folding safety railings 2202 and 2204 in their unfolded state. In the locked state, a stop plate 2308 (FIG. 23) on the free end of panel 2306 may abut against and be latched by its lock tab (not visible) to the right side of hatch cover 2106, and a stop plate 2408 on the free end of panel 2314 may abut against and be latched by its lock tab (not visible) to the left side of hatch cover 2104.

Various other adaptations and combinations of features of the examples disclosed are within the scope of the invention. Numerous examples are encompassed by the following claims.

What is claimed is:

1. A safety railing system for an underground enclosure, comprising:
- a hatch frame for the underground enclosure;
- a first folding safety railing, comprising:
- a first panel having a first edge pivotally connected to a first edge of the hatch frame; and
- a second panel pivotally connected to a second edge of the first panel, the second edge of the first panel being perpendicular to the first edge of the first panel;
- a second folding safety railing, comprising:
- a third panel having a first edge pivotally connected to a second edge of the hatch frame, the second edge of the hatch frame being parallel to the first edge of the hatch frame; and
- a fourth panel pivotally connected to a second edge of the third panel, the second edge of the third panel being perpendicular to the first edge of the third panel.

2. The safety railing system of claim 1, wherein:
- the first folding safety railing unfolds along the first edge and a third edge of the hatch frame, the third edge being adjacent to the first edge of the hatch frame;
- and
- the second folding safety railing unfolds along the second edge and a fourth edge of the hatch frame, the fourth edge being adjacent to the second edge of the hatch frame.

3. The safety railing system of claim 1, wherein the underground enclosure comprises an underground utility enclosure.

4. A safety railing system for an underground enclosure, comprising:
- a first hatch cover, the first hatch cover pivotally connected to a hatch frame for the underground enclosure;
- a first folding safety railing, comprising:
- a first panel pivotally connected to the first hatch cover; and
- a second panel pivotally connected to the first panel, wherein:
- a first edge of the first panel is pivotally connected to the first hatch cover; and
- the second panel is pivotally connected to a second edge of the first panel, the first edge and the second edge being parallel.

5. The safety railing system of claim 4, wherein the second panel comprises a drop bolt that is extendable to lock the second panel.

6. The safety railing system of claim 4, further comprising:
- a second folding safety railing, comprising:
- a third panel pivotally connected to the first hatch cover; and
- a fourth panel pivotally connected to the third panel.

7. The safety railing system of claim 6, wherein:
- the underground enclosure comprises an underground utility enclosure;
- the first panel is pivotally connected to a first edge of the first hatch cover;
- the first folding safety railing includes additional panels;
- the first folding safety railing unfolds along two edges of the hatch frame;
- the third panel is pivotally connected to a second edge of the first hatch cover, the first edge and the second edge being parallel; and
- the second folding safety railing unfolds along one edge of the hatch frame.

8. The safety railing system of claim 6, further comprising a second hatch cover for the hatch frame, wherein:
- the underground enclosure comprises an underground utility enclosure;
- the first panel is pivotally connected to an edge of the first hatch cover;
- the first folding safety railing unfolds along a first edge of the hatch frame;
- the third panel is pivotally connected to an edge of the second hatch cover that is diagonally across from the edge of the first hatch cover; and
- the second folding safety railing unfolds along a second edge of the hatch frame that is opposite the first edge of the hatch frame.

9. A safety railing system for an underground enclosure, comprising:
- a hatch frame for the underground enclosure or a first hatch cover for the hatch frame; and
- a first folding safety railing, comprising:
- a first panel pivotally connected to the hatch frame or the first hatch cover;
- a second panel pivotally connected to the first panel; and
- first and second extensions that are extendable from the first and the second panels to increase the first folding safety railing's height.

10. The safety railing system of claim 9, wherein the underground enclosure comprises an underground utility enclosure.

11. A method for operating a safety railing system for an underground enclosure, comprising:
- swinging open or removing a first hatch cover from a hatch frame for the underground enclosure to expose a first folding safety railing that was in the underground enclosure; and
- unfolding the first folding safety railing along at least one edge of the hatch frame, comprising:
- swinging open a first panel pivotally connected to the hatch frame or the first hatch cover; and
- swinging open a second panel pivotally connected to the first panel.

12. The method of claim 11, wherein:
- the first hatch cover is pivotally connected to the hatch frame;
- a first edge of the first panel is pivotally connected to the first hatch cover; and
- the second panel is pivotally connected to a second edge of the first panel, the first edge and the second edge being parallel.

13. The method of claim 11, wherein:
- a first edge of the first panel is pivotally connected to the hatch frame; and the second panel is pivotally connected to a second edge of the first panel, the first edge and the second edge being perpendicular.

14. The method of claim 11, further comprising lowering a drop bolt from the second panel into a socket fixed to the hatch frame to lock the second panel.

15. The method of claim 11, further comprising raising first and second extensions from the first and the second panels to increase the first folding safety railing's height.

16. The method of claim 11, further comprising:

unfolding a second folding safety railing, comprising:

swinging open a third panel pivotally connected to the hatch frame or the first hatch cover; and swinging open a fourth panel pivotally connected to the third panel.

17. The method of claim 16, wherein:

the underground enclosure comprises an underground utility enclosure;

the first panel is pivotally connected to a first edge of the first hatch cover;

the first folding safety railing includes additional panels;

the first folding safety railing unfolds along two edges of the hatch frame;

the third panel is pivotally connected to a second edge of the first hatch cover, the first edge and the second edge being parallel; and the second folding safety railing unfolds along one edge of the hatch frame.

18. The method of claim 16, further comprising swinging open a second hatch cover from the hatch frame, wherein:

the underground enclosure comprises an underground utility enclosure;

the first panel is pivotally connected to an edge of the first hatch cover;

the first folding safety railing unfolds along a first edge of the hatch frame;

the third panel is pivotally connected to an edge of the second hatch cover that is diagonally across from the edge of the first hatch cover; and the second folding safety railing unfolds along a second edge of the hatch frame that is opposite the first edge of the hatch frame.

19. The method of claim 16, wherein:

the underground enclosure comprises an underground utility enclosure;

the first panel is pivotally connected to a first edge of the hatch frame;

the first folding safety railing unfolds along the first edge and a second edge of the hatch frame, the second edge being adjacent to the first edge of the hatch frame;

the third panel is pivotally connected to a third edge of the hatch frame that is opposite of the first edge of the hatch frame; and the second folding safety railing unfolds along the third edge and a fourth edge of the hatch frame, the fourth edge being adjacent to the third edge of the hatch frame.

20. The method of claim 11, wherein the first hatch cover is pivotally connected to the hatch frame.

* * * * *